US007517555B2

(12) United States Patent
Kikui et al.

(10) Patent No.: US 7,517,555 B2
(45) Date of Patent: Apr. 14, 2009

(54) COPPER PLATING SOLUTION AND METHOD FOR COPPER PLATING

(75) Inventors: Fumiaki Kikui, Osaka (JP); Kaoru Kojima, Kyoto (JP); Yoriyoshi Ooka, Osaka (JP); Kohshi Yoshimura, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 371 days.

(21) Appl. No.: 10/474,210

(22) PCT Filed: Apr. 26, 2002

(86) PCT No.: PCT/JP02/04240

§ 371 (c)(1),
(2), (4) Date: Oct. 20, 2003

(87) PCT Pub. No.: WO02/088423

PCT Pub. Date: Nov. 7, 2002

(65) Prior Publication Data

US 2004/0137162 A1 Jul. 15, 2004

(30) Foreign Application Priority Data

Apr. 27, 2001 (JP) ..... 2001-131033

(51) Int. Cl.

| | |
|---|---|
| ***B05D 7/00*** | (2006.01) |
| ***B05D 1/18*** | (2006.01) |
| ***C23C 18/38*** | (2006.01) |
| ***C23C 18/40*** | (2006.01) |

(52) U.S. Cl. ..... 427/127; 427/436; 427/437; 427/443.1; 106/1.23; 106/1.26; 205/85; 205/295; 205/296; 205/149

(58) Field of Classification Search ..... 427/437, 427/127

See application file for complete search history.

(56) References Cited

U.S. PATENT DOCUMENTS

| | | | | | |
|---|---|---|---|---|---|
| 3,615,732 | A | * | 10/1971 | Shipley et al. | 106/1.23 |
| 3,635,758 | A | * | 1/1972 | Schneble et al. | 427/98.4 |
| 4,209,331 | A | * | 6/1980 | Kukanskis et al. | 106/1.23 |
| 4,391,742 | A | * | 7/1983 | Steigerwald et al. | 252/512 |
| 4,617,205 | A | * | 10/1986 | Darken | 427/305 |
| 4,650,691 | A | * | 3/1987 | Kinoshita et al. | 427/8 |
| 5,302,464 | A | * | 4/1994 | Nomura et al. | 428/551 |
| 5,750,018 | A | * | 5/1998 | Brasch | 205/295 |
| 6,609,783 | B1 | * | 8/2003 | Koyama et al. | 347/58 |

FOREIGN PATENT DOCUMENTS

| | | | |
|---|---|---|---|
| JP | 56-136970 | | 10/1981 |
| JP | 64-62475 | | 3/1989 |
| JP | 1-263278 | | 10/1989 |
| JP | 3-283607 | | 12/1991 |
| JP | 11-217689 | * | 8/1999 |
| JP | 2001-131761 | | 5/2001 |

OTHER PUBLICATIONS

Honma, et al "Electroless Copper Deposition Process Using Glyoxylic Acid as a Reducing Agent", J. Electrochem. Soc., vol. 141, No. 3, Mar. 1994, pp. 730-733.*

* cited by examiner

*Primary Examiner*—Katherine A Bareford
(74) *Attorney, Agent, or Firm*—Kratz, Quintos & Hanson, LLP

(57) ABSTRACT

A copper plating solution according to the present invention is characterized by that it comprising 0.03 mol/L to 0.5 mol/L of copper sulfate, 0.05 mol/L to 0.7 mol/L of ethylenediaminetetraacetic acid and 0.02 mol/L to 0.3 mol/L of sulfite, and has a pH adjusted to 5.0 to 8.5. A method for copper plating according to the present invention is characterized by that it comprises using the copper plating solution above. The copper plating solution and the method for copper plating according to the present invention stably provide a uniform copper plating film excellent in adhesion on the surface of an article to be plated, such as rare earth metal-based permanent magnet.

9 Claims, No Drawings

COPPER PLATING SOLUTION AND METHOD FOR COPPER PLATING

TECHNICAL FIELD

The present invention relates to a copper plating solution and a method for copper plating, which stably provide a uniform copper plating film excellent in adhesion on the surface of an article to be plated, such as rare earth metal-based permanent magnet.

BACKGROUND ART

Rare earth metal-based permanent magnets such as R—Fe—B based permanent magnets, which are represented by Nd—Fe—B based permanent magnet, possess high magnetic properties and are now utilized in various fields. In particular, bonded magnets using magnetic powder and resin binders as the principal components are excellent in dimensional precision and can be easily tailored into desired shapes or into monolithic molding. Therefore, a variety of shaped bonded magnets such as ring-shaped magnet are used widely in electronic appliances and the like.

However, rare earthmetal-based permanent magnets contain metallic species (particularly R) prone to oxidative corrosion under the atmosphere. Thus, in case they are used without applying surface treatment, corrosion proceeds from the surface due to the effect of acids, alkalis, water, and the like that are slightly present in air, and rust generates as a result. This causes deterioration or fluctuation in magnetic properties. Moreover, in case rust generates on magnets assembled in devices such as magnetic circuits, it is feared that rust is scattered to contaminate peripheral components. Accordingly, in case of using rare earthmetal-based permanent magnets, it is required to impart corrosion resistance to the magnet.

Various methods are proposed to present for imparting corrosion resistance to an article to be plated, e.g., a rare earth metal-based permanent magnet, and a method of forming copper plating film on a surface of an article to be plated by electroless plating method is one of such methods.

In the copper plating method using electroless plating method, generally employed is the chemical reduction plating method, which comprises adding a reducing agent in a copper plating solution containing copper sulfate and ethylenediaminetetraacetic acid as the principal components, and then, by using the reducing agent, selectively depositing copper ions in the copper plating solution on a catalyst-activated surface of the article to be plated. According to this method, the copper deposition reaction continues so long as the copper deposit remains catalytically active with respect to the oxidation reaction of the reducing agent. Thus, a copper plating film of desired film thickness can be formed on the surface of the article to be plated in accordance with the time duration of immersing the article in the copper plating solution. In this method, formaldehyde is generally used as the reducing agent in an alkaline bath condition.

As a method for forming a copper plating film on the surface of an article to be plated, the copper plating method employing chemical reduction plating method as described above is of high practical value. However, in case of the reductive deposition reaction using formaldehyde, gaseous hydrogen generates according to the reaction mechanism. The bubbles of gaseous hydrogen negatively influence the adhesion of copper plating film onto the articles to be plated, particularly those having concave portions such as voids on the surface, such as bonded magnets. Moreover, in case of the articles to be plated that undergo hydrogen embrittlement, such as rare earth metal-based permanent magnets, gaseous hydrogen casts unfavorable effects to the articles themselves.

Accordingly, an object of the present invention is to provide a copper plating solution and a method for copper plating that stably allow formation of a uniform copper plating film excellent in adhesion on the surface of an article to be plated, such as rare earth metal-based permanent magnet.

DISCLOSURE OF THE INVENTION

In the light of the aforementioned circumstances, the present inventors have made extensive studies, and instead of the chemical reduction plating method using a reducing agent such as formaldehyde, they paid attention to the classical ion exchange method, in which copper deposits are formed on the surface of the article to be plated without using any reducing agent, and is based on the exchange reaction of metallic ions. As the copper plating solutions for use in the ion exchange method, known is such containing copper sulfate and ethylenediaminetetraacetic acid as the principal components; however, since the solution is acidic with the pH value in a range of from 4 to 5, it is not applicable to rare earthmetal-based permanent magnets that are not stable under acidic conditions. It is possible to adjust the pH of the solution in a neutral region by adding sodium hydroxide and the like; however, it has been found that, in case such copper plating solution is used by adjusting the pH of the solution in a neutral region, there occurs problems as such that the growth rate of the copper plating film by the deposition of copper becomes too low, or that the resulting plating film suffers inferior adhesion properties with respect to the rare earth metal-based permanent magnet. Accordingly, further studies have been conducted, and it has been found that, by adding sulfite in a copper plating solution containing copper sulfate and ethylenediaminetetraacetic acid as the principal components, with the content of each of the components adjusted to a predetermined composition and the pH adjusted in a predetermined range, the resulting copper plating solution is applicable to articles such as rare earth metal-based permanent magnets, and that it is capable of stably forming a uniform copper plating film excellent in adhesion on the surface of the article to be plated.

The present invention has been made based on the above findings, and the copper plating solution according to the present invention is, characterized by that it comprises 0.03 mol/L to 0.5 mol/L of copper sulfate, 0.05 mol/L to 0.7 mol/L of ethylenediaminetetraacetic acid and 0.02 mol/L to 0.3 mol/L of sulfite, and has a pH adjusted to 5.0 to 8.5.

The copper plating solution is characterized by that it is a copper plating solution as described above wherein the sulfite is sodium sulfite and/or potassium sulfite.

The method for copper plating an article to be plated according to the present invention is, characterized by that it comprises using the copper plating solutions as described above.

The method for copper plating is characterized by that it is a copper plating method as described above wherein the copper plating method is electroless plating method.

The method for copper plating is characterized by that it is a copper plating method as described above wherein the article to be plated is a rare earth metal-based permanent magnet.

The method for copper plating is characterized by that it is a copper plating method as described above wherein the rare earth metal-based permanent magnet is a bonded magnet.

The method for copper plating is characterized by that it is a copper plating method as described above wherein the bonded magnet is ring-shaped.

BEST MODE FOR CARRYING OUT THE INVENTION

In the copper plating solution of the present invention, the concentration of copper sulfate is confined in a range of from 0.03 mol/L to 0.5 mol/L. If the concentration should be lower than 0.03 mol/L, there is fear of impairing the copper deposition efficiency; on the other hand, if the concentration should exceed 0.5 mol/L, copper sulfate tends to precipitate easily, and it may be mixed in the copper plating film that is formed on the surface of the article to be plated.

The concentration of ethylenediaminetetraacetic acid is confined in a range of from 0.05 mol/L to 0.7 mol/L. If the concentration should be lower than 0.05 mol/L, there is fear that the copper ions in the copper plating solution cannot be sufficiently complexed as to cause copper precipitation; on the other hand, if the concentration should exceed 0.7 mol/L, it is feared to result in the formation of an uneven copper plating film.

As the sulfite, for instance, sodium sulfite or potassium sulfite is used either alone or as a mixture of both. The concentration of the sulfite is confined in a range of from 0.02 mol/L to 0.3 mol/L. If the concentration should be lower than 0.02 mol/L, there is fear of impairing the copper deposition efficiency, and dark brown colored impurities may be mixed in the formed copper plating film; on the other hand, if the concentration should exceed 0.3 mol/L, it is feared to result in the formation of an uneven copper plating film.

The reason for limiting the pH of the copper plating solution of the present invention in a range of from 5.0 to 8.5 is as follows. If the pH should be lower than 5.0, it is feared that difficulties might be found on applying the solution to articles to be plated such as rare earth metal-based permanent magnets that are not stable under acidic conditions; on the other hand, if the pH should exceed 8.5, there is fear of impairing the adhesiveness of the copper plating film on the article to be plated. If necessary, the pH of the copper plating solution of the present invention may be adjusted by using a known pH adjusting agent such as sulfuric acid, sodium hydroxide, potassium hydroxide, and the like.

If necessary, known additives may be added in a proper concentration to the copper plating solution of the present invention. For instance, 0.01 mol/L to 0.2 mol/L of sodium tartarate and the like may be added with the purpose of improving stability of the bath containing a complex of copper ion and sulfite or a complex of copper ion and ethylenediaminetetraacetic acid, or 0.2 mol/L to 0.6 mol/L of sodium sulfate and the like may be added as a conductor to the copper plating solution.

Furthermore, hydrogensulfite such as sodium hydrogensulfite may be used in the place of the sulfite, and by adjusting pH in the range of from 5.0 to 8.5, the chemical equilibrium between the concentration of the sulfite and the concentration of the hydrogensulfite is made to act so that the concentration of the sulfite can be elevated as such that the concentration of the sulfite in the copper plating solution should be adjusted in a range of from 0.02 mol/L to 0.3 mol/L.

The copper plating solution of the present invention can be applied to a copper plating method using electrolytic plating method. However, it is practically more valuable in case it is applied to a copper plating method using electroless plating method in the point that a uniform copper plating film with excellent adhesion properties is stably formed on the surface of an article to be plated.

More specifically, since the copper plating solution of the present invention is free from formaldehyde, unfavorable effects of generating gaseous hydrogen on forming copper plating films by electroless plating method can be avoided. Thus, a uniform copper plating film excellent in adhesion can be formed with superior coverage on the surface of an article to be plated having concave portions such as voids on the surface, such as bonded magnets, and no embrittlement is caused on rare earth metal-based permanent magnets.

From the viewpoint of assuring favorable operability in case of applying the copper plating solution of the present invention to copper plating method using electroless plating method, the process is preferably carried out in a temperature range of from 25° C. to 70° C. and for a duration of 30 minutes to 90 minutes.

As the articles to be plated to which the copper plating solution of the present invention is favorably applied, as rare earth metal-based permanent magnets, particularly as bonded magnets, mentioned are the follows.

A bonded magnet may be a magnetically isotropic bonded magnet or a magnetically anisotropic bonded magnet so long as the bonded magnet contains magnetic powder and resin binders as the principal components. In addition to the magnets that are bonded and shaped by using a resin binder, those bonded and shaped by using a metallic binder or an inorganic binder are included in the bonded magnets above. Furthermore, the binder may contain fillers.

Bonded magnets differing in compositions and crystal structures are known, and the invention is applicable to all of these.

For instance, there can be mentioned an anisotropic R—Fe—B based bonded magnet as disclosed in Japanese Patent Laid-Open No. 92515/1997, a Nd—Fe—B based nanocomposite magnet having a soft magnetic phase (e.g., α-Fe and $Fe_3B$) and a hard magnetic phase ($Nd_2Fe_{14}B$) as disclosed in Japanese Patent Laid-Open No. 203714/1996, or a bonded magnet using an isotropic Nd—Fe—B based magnetic powder (e.g., MQP-B (trade name) produced by MQI corp.) prepared by a widely used conventional melt quenching process.

Further included are the R—Fe—N based bonded magnets expressed by $(Fe_{1-x}R_x)_{1-y}N_y$ ($0.07 \leqq x \leqq 0.3$, $0.001 \leqq y \leqq 0.2$) as disclosed in Japanese Patent Publication No. 82041/1993.

The magnetic powder constituting the bonded magnet can be obtained by methods such as a dissolution and milling process which comprises melting a rare earth metal-based permanent magnet alloy, subjecting it to a casting treatment to produce an ingot, and pulverizing the ingot; a sintered-product pulverizing process which comprises producing a sintered magnet and then pulverizing the sintered magnet; a reduction and diffusion process which produces a magnetic powder directly by the Ca reduction; a rapid solidification process which comprises producing a ribbon foil of a rare earth metal-based permanent magnet alloy by a melting jet caster, and pulverizing and annealing the ribbon foil; an atomizing process which comprises melting a rare earth metal-based permanent magnet alloy, powdering the alloy by atomization and subjecting the powdered alloy to a heat treatment; and a mechanical alloying process which comprises powdering a starting metal, finely pulverizing the powdered metal and subjecting the finely pulverized metal to a heat treatment, and the like.

Furthermore, the magnetic powder constituting the R—Fe—N based bonded magnet may be obtained by a gas nitrided process, which comprises pulverizing a rare earth metal-based permanent magnet alloy, nitriding the pulverizing alloy in gaseous nitrogen or gaseous ammonia, and then finely pulverizing the resulting alloy.

As a method for applying magnetic anisotropy to bulk and magnetic powder, there can be employed a hot working and crushing method (Japanese Patent Publication No. 20242/1992), which comprises sintering an alloy powder obtained by rapid solidification process at low temperatures by means of hot pressing and the like, and then crushing a bulk magnetic body to which magnetic anisotropy is imparted by means of hot swaging; a packed rolling method (Japanese Patent Publication No. 2596835), which comprises directly feeding and sealing an alloy powder obtained by rapid solidification process in a metallic vessel, and then imparting magnetic anisotropy to the powder by plastic working such as hot rolling; a method of hot working and crushing the ingot (Japanese Patent Publication No. 66892/1995), which comprises hot plastic working an alloy ingot, and then obtaining a magnetic powder having imparted thereto magnetic anisotropy by crushing; and an HDDR method (Japanese Patent Publication No. 82575/1994), which comprises occluding hydrogen in rare earth metal-based permanent magnet alloy by heating the alloy in hydrogen, followed by dehydrogenation treatment, and then cooling to obtain a magnetic powder.

As the methods for imparting magnetic anisotropy, they are not only limited to the combinations of the starting alloy and the means for rendering the powder anisotropy above, but also employable are other methods in which the starting material and methods are properly combined.

As compositions of the magnetic powder available from the methods above, mentioned are, for instance, those containing 8% by atomic (at %) to 30 at % of R (where, R contains at least one type selected from rare earth elements inclusive of Y, preferably, is based on light rare earth elements such as Nd and Pr, or is a mixture with Nd, Pr, and the like), 2 at % to 28 at % of B (where, a part of B may be replaced by C), and 65 at % to 84 at % of Fe (where, a part of Fe may be replaced by at least one of Co and Ni, provided that Co accounts for 50% or less of Fe, and Ni accounts for 8% or less of Fe).

In order to increase the coercive force and the corrosion resistance of the resulting bonded magnet, at least one of the following elements can be added into the starting powder: 3.5 at % or less of Cu, 2.5 at % or less of S, 4.5 at % or less of Ti, 15 at % or less of Si, 9.5 at % or less of V, 12.5 at % or less of Nb, 10.5 at % or less of Ta, 8.5 at % or less of Cr, 9.5 at % or less of Mo, 9.5 at % or less of W, 3.5 at % or less of Mn, 9.5 at % or less of Al, 2.5 at % or less of Sb, 7 at % or less of Ge, 3.5 at % or less of Sn, 5.5 at % or less of Zr, 5.5 at% or less of Hf, 8.5 at % or less of Ca, 8.5 at % or less of Mg, 7 at % or less of Sr, 7 at % or less of Ba, 7 at % or less of Be, and 10 at % or less of Ga.

Preferably, the composition for the magnetic powder for use in the Nd—Fe—B based nanocomposite magnet contains from 1 at % to 10 at % of R, 5 at % to 28 at % of B, and substantially Fe for balance.

In case resin binder is used as the binder for use in the production of bonded magnet, any resin suitable for the molding method can be selected. For instance, as the resin suitable for compression molding, there can be mentioned an epoxy resin, phenolic resin, and diallyl phthalate, and the like. As the resin suitable for injection molding, mentioned are polyamide resins such as 6-nylon and 12-nylon, polyphenylene sulfide, and polybutylene phthalate, and the like. As the resins suitable for extrusion molding and rolling, mentioned are poly(vinyl chloride), acrylonitrile-butadiene rubber, chlorinated polyethylene, natural rubber, chlorosulfonated polyethylene, and thermoplastic elastomer, and the like.

Various methods for producing bonded magnets are known; for instance, generally employed is a compression molding comprising mixing at a predetermined blending ratio, the magnetic powder and resin binder, together with a silane-based or titanium-based coupling agent, a lubricant for facilitating molding, a binding agent for resin and inorganic fillers, if necessary, followed by kneading and compression molding, and then heating the resulting molding to cure the resin. Also employed in general are injection molding, extrusion molding, and rolling.

Another film may be laminated on the surface of the copper plating film thus formed by using the copper plating solution of the present invention to further impart corrosion resistance and functionality to the article. In forming a nickel plating film on the surface of the bonded magnet, by forming a copper plating film by using the copper plating solution of the present invention as a base film under a nickel plating film, not only the magnet base can be prevented from being corroded by the nickel plating solution, but a nickel plating film can be formed with excellent adhesion. Furthermore, the surface of a copper plating film formed by using the copper plating solution of the present invention may be subjected to oxidation treatment according to black-color copper oxide method using a chemical conversion treatment solution such as alkaline potassium persulfate solution, such that a layer of cupric oxide film may be formed to render the surface highly anti-corrosive even in case the article is immersed in a highly corrosive oxidative electrolytic solution.

EXAMPLES

The invention is described in further detail by referring to examples below, but it should be understood that the invention is not limited thereby.

Example 1

An alloy powder prepared by rapid solidification process, consisting of particles having an average particle diameter of 150 μm and containing 12% by atomic (at %) of Nd, 77 at % of Fe, 6 at % of B, and 5 at % of Co, was kneaded with epoxy resin added at a concentration of 2 wt %. The resulting mixture was compression molded under a pressure of 7 ton/cm$^2$, and was cured at 170° C. for 1 hour to obtain a Nd—Fe—B based ring-shaped bonded magnet (denoted hereinafter as "magnet test piece A") 31.0 mm in outer diameter, 28.5 mm in inner diameter, and 4.0 mm in height. The magnet test piece A was subjected to barrel polishing to remove the surface contaminated layer, and was degreased with a 0.1 mol/L of sodium hydroxide aqueous solution to be subjected to the following experiments.

copper plating solutions differing in concentration of sudium sulfite were prepared by varying the addition of sodium sulfite in a solution containing 0.1 mol/L of copper sulfate, 0.15 mol/L of ethylenediaminetetraacetic acid, and 0.5 mol/L of sodium sulfate, and the pH of the solution was adjusted to 6.9 using sodium hydroxide. The magnet test piece A was immersed into the copper plating solution heated to 60° C. while varying the time duration of immersion to form a copper plating film on the surface of the magnet test piece A according to electroless plating method. The results are given in Table 1.

TABLE 1

The change in copper plating film thickness (μm) with changing concentration of sodium sulfite and immersion time duration.

| Immersion time duration | Concentration of sodium sulfite (mol/L) | | | | | |
|---|---|---|---|---|---|---|
| (minutes) | 0 | 0.04 | 0.08 | 0.12 | 0.16 | 0.20 |
| 30 | 0.2 | 0.7 | 0.8 | 0.8 | 0.8 | 0.8 |
| 60 | 0.3 | 1.2 | 1.7 | 1.7 | 1.7 | 1.7 |
| 90 | 0.5 | 1.5 | 2.0 | 2.0 | 2.0 | 2.0 |

(unit: μm)

Table 1 clearly reads that, by adding sodium sulfite in The copper plating solution, the film thickness of the copper plating film formed on the surface of the magnet test piece A increases with increasing concentration of sodium sulfite and with increasing time duration of immersion up to a sodium sulfite concentration of 0.08 mol/L. The copper plating film formed on the surface of the magnet test piece A using the copper plating solution containing sodium sulfite exhibited clear pink color, and the copper plating film remained free of peeling off when subjected to cross cutting using a cutter, showing excellent adhesion to the surface of the magnet test piece A. By adding sodium sulfite in the copper plating solution, in the process of forming the copper plating film, the results thus obtained was believed in the attribution to the effect of sodium sulfite functioning as a reaction stabilizer, which stabilized monovalent copper ion ($Cu^{1+}$) by forming a complex of $Cu^{1+}$ with sulfurous acid, and thereby allowing efficient and stable ion exchange reaction to take place.

Example 2

An alloy powder prepared by rapid solidification process, consisting of particles having an average particle diameter of 150 μm and containing 12 at % of Nd, 77 at % of Fe, 6 at % of B, and 5 at % of Co, was kneaded with epoxy resin added at a concentration of 2 wt %. The resulting mixture was compression molded under a pressure of 7 ton/cm$^2$, and was cured at 170° C. for 1 hour to obtain a Nd—Fe—B based ring-shaped bonded magnet (denoted hereinafter as "magnet test piece B") 30.2 mm in outer diameter, 28.0 mm in inner diameter, and 4.0 mm in height. The magnet test piece B was subjected to barrel polishing to remove the surface contaminated layer, and was degreased with a 0.1 mol/L of sodium hydroxide aqueous solution to be subjected to the following experiments.

A copper plating solution was prepared by adding sodium sulfite in an amount to yield a concentration of 0.12 mol/L in a solution containing 0.1 mol/L of copper sulfate, 0.15 mol/L of ethylenediaminetetraacetic acid, and 0.5 mol/L of sodium sulfate, and the pH of the solution was adjusted to 6.9 by using sodium hydroxide. The magnet test piece B thus obtained was immersed into the copper plating solution heated to 60° C. for 60 minutes to form a copper plating film on the surface of the magnet test piece B according to electroless plating method.

The copper plating film formed on the surface of the magnet test piece B exhibited clear pink color with a film thickness of 1.7 μm, and the copper plating film remained free of peeling off when subjected to cross cutting using a cutter, showing excellent adhesion to the surface of the magnet test piece B.

Example 3

A copper plating film was formed on the surface of magnet test piece B by using the same copper plating solution and by performing electroless plating method under the same conditions as in Example 2, except for changing the addition of sodium sulfite, such that the concentration thereof would become 0.04 mol/L instead of 0.12 mol/L.

The copper plating film formed on the surface of the magnet test piece B exhibited clear pink color with a film thickness of 1.2 μm, and the copper plating film remained free of peeling off when subjected to cross cutting using a cutter, showing excellent adhesion to the surface of the magnet test piece B.

Comparative Example 1

A copper plating film was formed on the surface of magnet test piece B by using the same copper plating solution and by performing electroless plating method under the same conditions as in Example2, except for not adding any sodium sulfite, instead of adding sodium sulfite to a concentration of 0.12 mol/L.

The copper plating film formed on the surface of the magnet test piece B was an impurity-containing dark brown colored film of 0.3 μm in thickness. Apart of the copper plating film peeled off when subjected to cross cutting using a cutter.

Comparative Example 2

A copper plating film was formed on the surface of magnet test piece B by using the same copper plating solution and by performing electroless plating method under the same conditions as in Example 2, except for adjusting the pH to 3.8 by using sulfuric acid instead of adjusting the pH to 6.9 by using sodium hydroxide.

However, a part of the surface of the magnet test piece B remained free of formation of copper plating film, and the copper plating film peeled off when subjected to cross cutting using a cutter.

Example 4

A copper plating solution was prepared by adding potassium sulfite in an amount to yield a concentration of 0.08 mol/L in a solution containing 0.1 mol/L of copper sulfate, 0.15 mol/L of ethylenediaminetetraaceticacid, 0.5mol/L of sodium sulfate, and 0.1 mol/L of sodium tartarate, and the pH of the solution was adjusted to 6.9 by using sodium hydroxide. The magnet test piece B subjected to barrel polishing for removal of the surface contaminated layer, and degreased with a 0.1 mol/L of sodium hydroxide aqueous solution was immersed into the thus obtained copper plating solution heated to 60° C. for 60 minutes to form a copper plating film on the surface of the magnet test piece B according to electroless plating method.

The copper plating film formed on the surface of the magnet test piece B exhibited clear pink color with a film thickness of 1.7 μm, and the copper plating film remained free of peeling off when subjected to cross cutting using a cutter, showing excellent adhesion to the surface of the magnet test piece B.

Comparative Example 3

A copper plating solution was prepared by adding 150 mL of 37% formaldehyde solution per 1 L of solution containing 0.1 mol/L of copper sulfate, 0.15 mol/L of ethylenediaminetetraacetic acid, 0.1 mol/L of sodium tartarate, and 0.1 mol/L of sodium sulfite, and the pH of the solution was adjusted to 10 by using sodium hydroxide. The magnet test piece B subjected to barrel polishing for removal of the surface contaminated layer, and degreased with a 0.1 mol/L of sodium hydroxide aqueous solution was immersed into the thus obtained copper plating solution heated to 30° C. for 30 minutes to form a copper plating film on the surface of the magnet test piece B according to electroless plating method. The copper plating solution was continuously stirred, such that the copper plating film should not result in an impurity-containing dark brown colored film.

As a result, a clear pink colored copper plating film was formed on the outer surface of the magnet test piece B, but the copper plating film was insufficiently formed on the inner surface, thereby leaving out non-plated portions (exposed magnet grain portions) . Accordingly, red colored rusts were found to form on the magnet test piece B several hours later. This was due to gaseous hydrogen generated by the reduction deposition reaction of formaldehyde, which bubbles prevented copper plating film from being formed satisfactorily on the inner surface.

Example 5

A copper plating solution was prepared by adding sodium sulfite in an amount to yield a concentration of 0.2 mol/L in a solution containing 0.1 mol/L of copper sulfate, 0.15 mol/L of ethylenediaminetetraacetic acid, and 0.5 mol/L of sodium sulfate, and the pH of the solution was adjusted to 7 by using sodium hydroxide. The magnet test piece A subjected to barrel polishing for removal of the surface contaminated layer, and degreased with a 0.1 mol/L of sodium hydroxide aqueous solution was immersed into the thus obtained copper plating solution heated to 60° C. for 60 minutes to form a copper plating film on the surface of the magnet test piece A according to electroless plating method. The copper plating film formed on the surface of the magnet test piece A exhibited clear pink color with a film thickness of 1.7 μm.

The magnet test piece A with the copper plating film formed on the surface was rinsed with water and dried, and a nickel plating film was formed on the surface of the copper plating film by performing electrolytic plating method in a nickel plating solution containing 0.91 mol/L of nickel sulfate, 0.19 mol/L of nickel chloride, and 0.57 mol/L of boric acid and its pH adjusted to 4 by using nickel carbonate, at a bath temperature of 50° C., a current density of 1.2 A/dm$^2$, and a time duration of 120 minutes. Thus was formed a nickel plating film of 19 μm in thickness on the surface of the copper plating film.

The magnet test piece A having a nickel plating film on the surface with copper plating film interposed was rinsed with water and dried, and was subjected to accelerated corrosion resistant test by allowing to stand for 50 hours under a high temperature and high humidity condition of 80° C. and 90% relative humidity. No changes and no rust generation were found on the surface of the nickel plating film.

Comparative Example 4

A nickel plating film of 24 μm in thickness was formed directly on the surface of the magnet test piece A by using the same nickel plating solution as that used in Example 5 and by performing electrolytic plating method, at a bath temperature of 50° C., a current density of 1.2 A/dm$^2$, and a time duration of 150 minutes.

The magnet test piece A having a nickel plating film formed on the surface thus obtained was rinsed with water and dried, and was subjected to accelerated corrosion resistant test by allowing to stand for 50 hours under a high temperature and high humidity condition of 80° C. and 90% relative humidity. As a result, cracks and bulging were found to occur, and numerous red-brown colored rusts generated on the surface of the nickel plating film.

INDUSTRIAL APPLICABILITY

The copper plating solution of the present invention is applicable to an article to be plated such as a rare earth metal-based permanent magnet, and it stably provides a uniform copper plating film excellent in adhesion on the surface of the article.

More specifically, since the copper plating solution of the present invention is free from formaldehyde, unfavorable effects of generating gaseous hydrogen on forming copper plating films by electroless plating method can be avoided. Thus, a uniform copper plating film excellent in adhesion can be formed with superior coverage on the surface of an article to be plated having concave portions such as voids on the surface, such as bonded magnets, and no embrittlement is caused on rare earth metal-based permanent magnets.

The invention claimed is:

1. A copper plating solution comprising 0.03 mol/L to 0.5 mol/L of copper sulfate, 0.05 mol/L to 0.7 mol/L of ethylenediaminetetraacetic acid and 0.02 mol/L to 0.3 mol/L of sodium sulfite and/or potassium sulfite, and has a pH adjusted to 5.0 to 8.5 and is free from formaldehyde, said solution does not produce gaseous hydrogen.

2. A method for copper plating an article to be plated, comprising using the copper plating solution as claimed in claim 1.

3. A method for copper plating as claimed in claim 2, wherein the copper plating method is electroless plating method.

4. A method for copper plating as claimed in claim 3, wherein the article to be plated is a rare earth metal-based permanent magnet.

5. A method for copper plating as claimed in claim 4, wherein the rare earth metal-based permanent magnet is a bonded magnet.

6. A method for copper plating as claimed in claim 5, wherein the bonded magnet is ring-shaped.

7. A method for copper plating as claimed in claim 2, wherein the article to be plated is a rare earth metal-based permanent magnet.

8. A method for copper plating as claimed in claim 7, wherein the rare earth metal-based permanent magnet is a bonded magnet.

9. A method for copper plating as claimed in claim 8, wherein the bonded magnet is ring-shaped.

* * * * *